United States Patent [19]

Langeler

[11] Patent Number: 4,473,101

[45] Date of Patent: Sep. 25, 1984

[54] SUN BLIND

[75] Inventor: Jan H. Langeler, Borculo, Netherlands

[73] Assignee: Verosol B.V., Enschede, Netherlands

[21] Appl. No.: 449,780

[22] Filed: Dec. 14, 1982

Related U.S. Application Data

[63] Continuation of Ser. No. 177,828, Aug. 13, 1980.

[51] Int. Cl.[3] ..... E06B 9/262; A47H 3/10

[52] U.S. Cl. ..... 160/84 R; 160/279

[58] Field of Search ..... 160/84 R, 85, 86, 168 R, 160/168 A, 279

[56] References Cited

U.S. PATENT DOCUMENTS

| | | | |
|---|---|---|---|
| 577,244 | 2/1897 | Forsyth | 160/279 |
| 1,229,523 | 6/1917 | Roehrich | 160/84 R |
| 3,946,788 | 3/1976 | Van Muyen | 160/84 R |
| 4,202,395 | 5/1980 | Heck et al. | 160/84 R |
| 4,212,341 | 7/1980 | Fisher | 160/84 R |

*Primary Examiner*—Peter M. Caun

*Assistant Examiner*—Cherney S. Lieberman

*Attorney, Agent, or Firm*—Kenyon & Kenyon

[57] ABSTRACT

A sun blind for a window, in particular a window occupying permanently or temporarily a slanting position and optionally being operative to be toppled about a horizontal axis, said sun blind comprising a horizontal profiled top bar fastened to or integrated with the header of the window frame, a horizontal profiled bottom bar operative to be moved with respect to said top bar, a sun blinding portion between said top bar and said bottom bar, lateral guides for guiding the ends of the bottom bar, said guides being provided along or within the side posts of the window frame, at least two cords running through apertures in the sun blinding portion and optionally an additional profiled bar along the bottom sill part of the window frame, whereby said cords serve solely for guiding the bottom bar and the sun blinding portion, while the ends of all cords are fastened to fixed points of the top bar, the bottom bar or the lateral guides of the sun blind.

5 Claims, 3 Drawing Figures

B
A
1
A5
3
4
A6
A2
A4
6
2
A7
A3
A1

6
B
A2
A
1
3
A1
4
A9
A4
2
A8
A3
A7
A5
5
A6

D
C
6
B2
1
B
A5
A
B1
3
6
4
A6
A2
A4
6
2
A7
B4
B3
A3
6
A1
B5

SUN BLIND

This application is a continuation of application Ser. No. 177,828, filed 8/13/80, abandoned.

BACKGROUND OF THE INVENTION

The present invention relates to a sun blind for a window, in particular a window occupying permanently or temporarily a vertical, slanting or a horizontal position and optionally being operative to be toppled about a horizontal axis, said sun blind comprising a horizontal profiled top bar fastened to or integrated with the header of the window frame, a horizontal profiled bottom bar operative to be moved with respect to said top bar, a sun blinding portion between said top bar and said bottom bar, lateral guides for guiding the ends of the bottom bar, said guides being provided along or within the side posts of the window frame, at least two cords running through apertures in the sun blinding portion and optionally an additional profiled bar along the bottom sill part of the window frame.

Sun blinds of this type are well known in practice and from the literature. As far as the present invention is concerned the construction of the sun blinding portion is quite immaterial. This sun blinding portion may for instance be in the shape of a pleated cloth, a Venitian blind having horizontal slats, a blackout curtain, an energy screen and the like.

In general it is more difficult to apply sun blinds for a window positioned in an oblique plane than for a window mounted in a vertical plane of a frontispiece. Many of such windows mounted in an oblique plane may moreover also be toppled about a horizontal axis in the window frame. This capability of being toppled may be necessary or desired in view of ventilation or cleaning purposes. This inversion or toppling capability of the window leads to an additional complication with respect to the application of a sun blind.

The known sun blinds for vertical windows are operated by cords for drawing up, i.e. two or more cords the ends of which are fastened to the profiled bottom bar and which may be hauled in for opening the sun blind. Through apertures in the sun blinding portion the cords run upwards to the profiled top bar and then through the top bar to one side of the window. Although this construction is quite satisfactory in case of vertical windows it is less suitable for windows in a slanting position and even less if the windows may moreover be toppled about a horizontal axis. In the latter case the profiled bottom bar should be capable moreover of fixation in the guides in any adjusted position. This fixation should furthermore be maintained upon changes in the position of the window and consequently of the sun blind. Accordingly there is sometimes provided a mechanical locking means for locking the end of the profiled bottom bar in the side guides.

The operation of the cords for drawing up is often very difficult especially when the window occupies a substantially horizontal position. When drawing up or lowering the sun blind it is moreover difficult to keep the bottom bar parallel to the top bar. Consequently the profiled bottom bar will often occupy an oblique position this not benefiting the appearance of the window, while upon hanging in a oblique position there is moreover quite some chance that the cords will be loaded heavier and will consequently be subject to increased wear and even breakage. The stowing away of the cords for drawing up next to the window forms an additional complication.

In case of sun blinds for windows having a larger width it will be required to provide apart from the left hand and right hand cords additional guiding cords in the middle or at several locations. In some sun blinds of the known types these guide cords also function as cords for drawing up. In other known types there are additional cords, steel wires or plastic threads as guide means. These additional cords and the like are then usually fastened in the profiled top bar of the sun blind, while running down through the sun blinding portion and the bottom bar and being fastened to the sill part of the window frame. These cords have the drawback that they will also remain in front of the window pane when the sun blind has been drawn up completely, this being very awkward in practice, for instance when cleaning the inside of the window pane. Moreover these cords very soon lose the taut condition thereof and are very often subject to breakage. In practice there is usually chosen the solution in which the additional guide cords also function as cords for drawing up but in that case it is of importance that the sun blind as such consists of a material having a substantially high stiffness so that in case of a Venetian blind the slats have to be made of aluminum or a rigid plastic.

SUMMARY OF THE INVENTION

The object of the invention is to improve on the known sun blind, this being achieved in accordance with the invention in that the cords serve solely for guiding the bottom bar and the sun blinding portion, while the end of all cords are fastened to fixed points of the top bar, the bottom bar or the lateral guide of the sun blind.

Accordingly the cords do not need to be hauled in for drawing up the sun blind. When the sun blind has to be closed the profiled bottom bar is seized by the hand and moved away from the profiled top bar in essentially the same way as in case of a spring roller curtain. Due to the guiding action of the cords maintained in a taut condition the profiled bottom bar cannot occupy an oblique position. Moreover the bottom bar will maintain any desired position without any additional locking and will not be subject to displacement either when the window is optionally inverted about a horizontal pivoting axis of the window frame.

In order to meet the size tolerances in the cord and to prevent breakage of a cord upon overloading there is included at least one spring element in each one of the cords.

In case of a somewhat wider sun blind it will be required to guide the sun blinding portion additionally in the center or at several places. According to a further embodiment of the invention there will be besides through apertures close to the lateral sides of the sun blinding portion also cords extending through apertures arranged therebetween.

The main advantage is that there will be no guide cords in front of the window pane when the sun blind is opened.

In sun blinds having additional guides there may be used for that purpose in accordance with the invention either the same cords or additional cords.

It will be clear that the sun blind according to the present invention may also be used for vertical windows. The term "windows" is meant to include not only windows in buildings but also for instance the rear or side windows of motor vehicles, of caravans and the like.

BRIEF DESCRIPTION OF THE DRAWING

The invention will now be elucidated further in detail with reference to the drawings in which.

DETAILED DESCRIPTION

Figure 1:
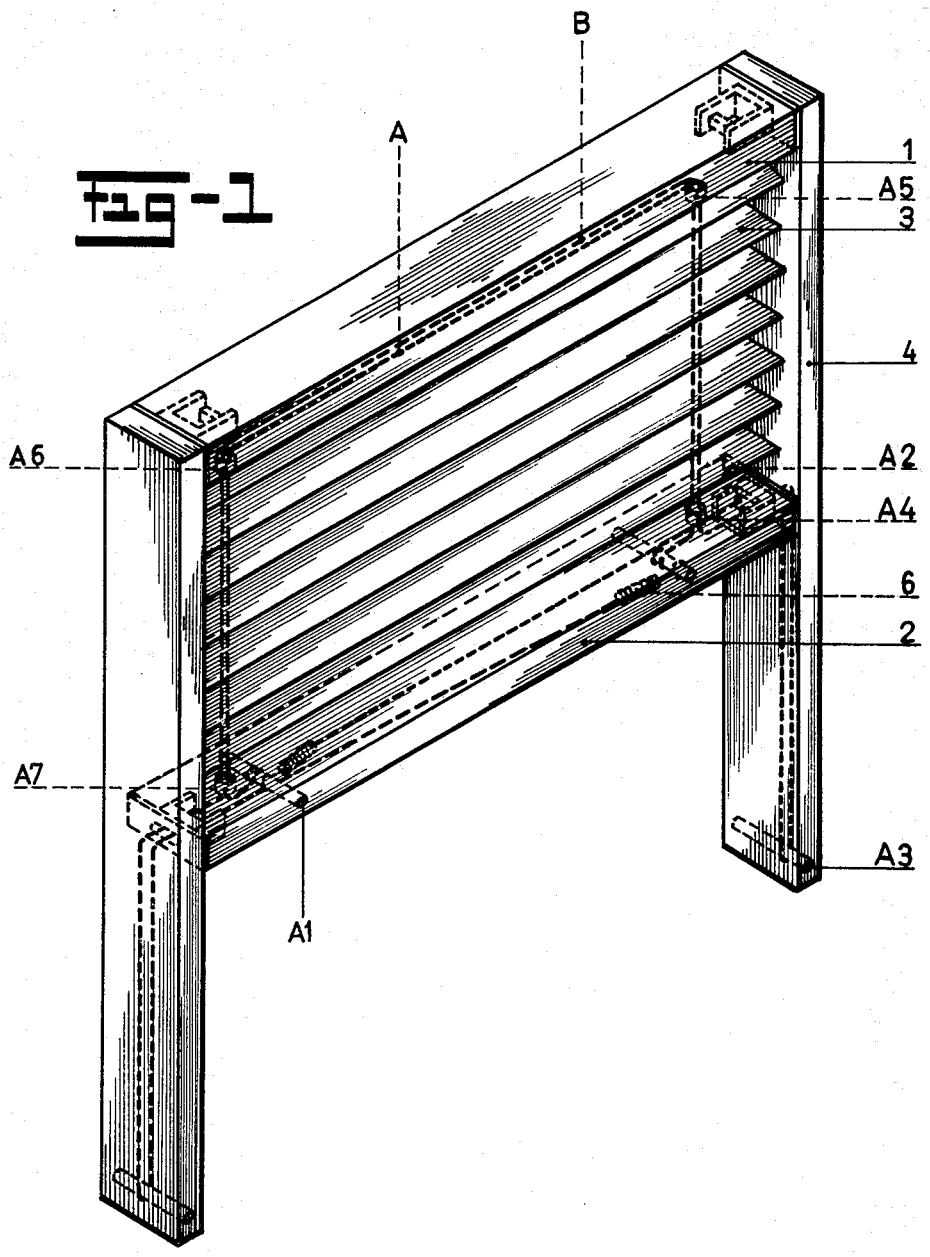
FIG. 1 shows a perspective view of a sun blind according to the present invention.

The not-shown window for which the sun blind according to the present invention is destined may be a vertically positioned window or a slanting window for instance a window in a pitched roof, with said window optionally being constructed in a known way as a hinged window or as a toppling window so that the window and consequently also the sun blind may be positioned at different angles of inclination.

In all figures the profiled upper bar of the sun blind has been indicated with the reference numeral 1, the profiled bottom bar with 2, the sun blinding portion with 3 and the lateral guides with 4. The additional profiled bar along the bottom sill part of the window frame in FIG. 2 has been indicated with the reference numeral 5.

The lateral guides 4 may be separate profiled bars fastened along the side parts (not shown) of the window frame or may be integrated with said side posts.

Preferably the different profiled bars are made of aluminum or plastic.

In the embodiments the sun blinding portion 3 may be in the shape of a pleated polyester cloth like that commercially marketed by applicants. The present invention may however also be applied in for instance a sun blind having horizontal slats made of aluminum or plastic. The present invention may be suitably applied for any type of sun blind that may be folded or slid together.

Figure 2:
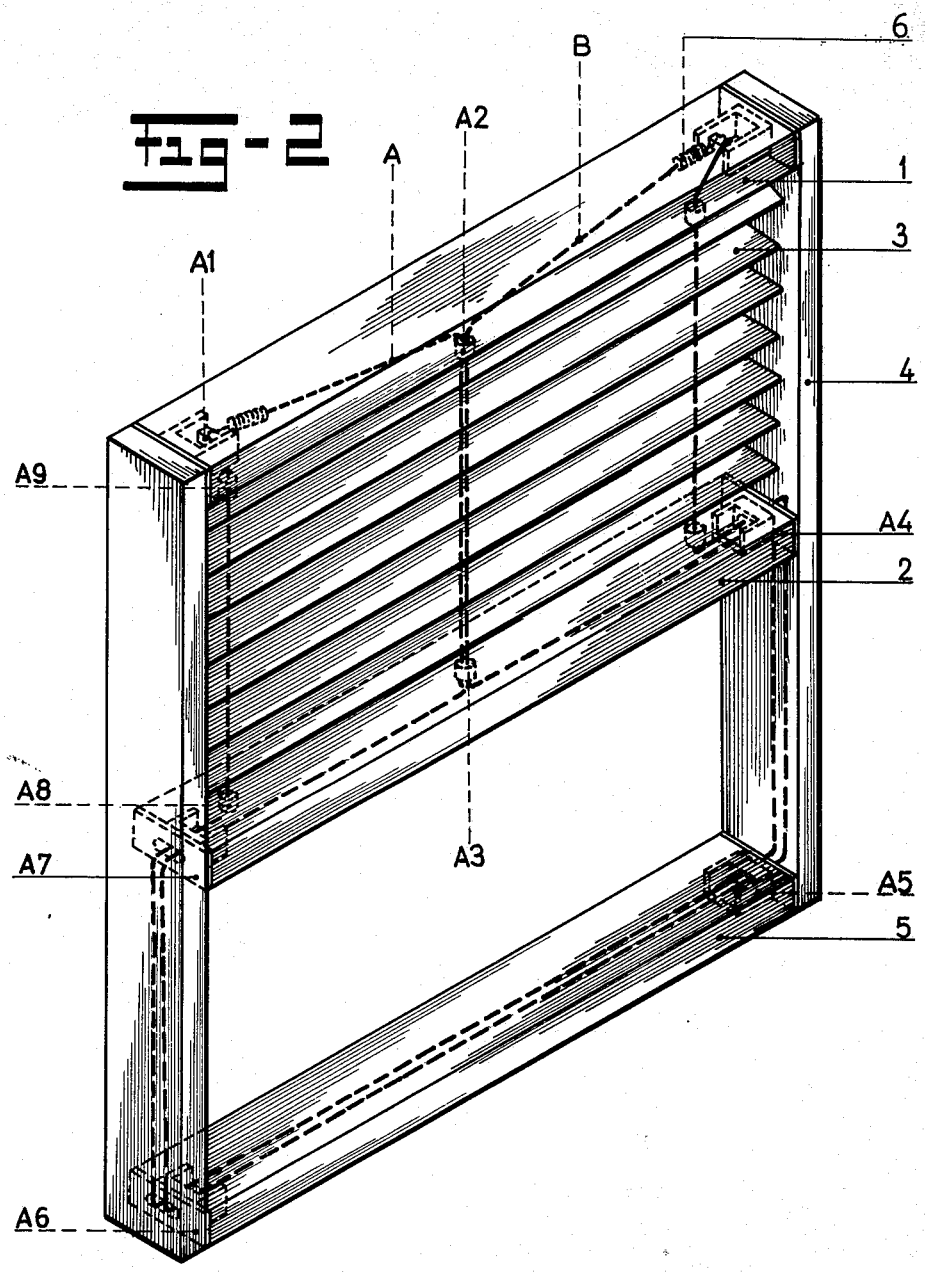
FIG. 2 corresponds to FIG. 1 though intended for a wider window and including a center guide and an additional profiled bar along the bottom sill part of the window frame.

In the embodiments according to FIGS. 1 and 2 there are used two cords A and B.

In the embodiment of FIG. 1 wherein no center guide is used, the cord A is fastened within the profiled bottom bar 2 at the point A1.

The cord A runs through the bottom bar 2 to the point A2, while leaving the bottom bar 2 at A2, running downwards through the space within the lateral guide 4 to A3, being inverted about a pin A3 and running back again to A2. At A2 the cord A enters the bottom bar 2 and runs through the bottom bar 2 to A4 while leaving the bottom bar 2 at A4, extending upwards through the sun blinding portion 3 to A5, entering the profiled top bar 1 at A5, running from A5 through the top bar 1 to A6 whereupon the cord leaves the top bar 1 at A6 and runs downwards through the sun blinding portion 3 to A7 while entering the bottom bar 2 at A7 and running through the bottom bar 2 to A1 where the cord A is fastened.

Close to the point A1 there has been incorporated a spring element 6 in the cord A for meeting size tolerances in the cord and for preventing breakage of the cord upon overloading.

The cord B takes a course that is symmetrical to that of cord A.

The sun blind according to the embodiment of FIG. 2 posesses a center guide provided by the cords A and B and contains furthermore an additional profiled bottom bar 5 along the bottom sill part of the window frame.

The cord A is again fastened at point A1 within the profiled top bar 1, while leaving the top bar 1 at A2, running downwards through the central apertures in the sun blinding portion 3 to A3 within the profiled bottom bar 2, whereupon the cord enters the bottom bar 2 at A3 and runs through the bottom bar 2 to A4. At A4 the cord leaves the bottom bar 2 and runs downwards to A5 while entering the additional profiled bar 5 at A5, running through said additional bar 5 to A6, running upwards from A6 to A7, running through the profiled bottom bar 2 from A7 to A8 whereupon the cord leaves the bottom bar 2 at A8 and extends upwards through the sun blinding portion 3 to A9, runs through the top bar 1 from A9 to A1 where the cord is fastened.

In this embodiment there is also incorporated a spring element 6 in the cord A close to the point A1.

The cord B takes a course that is symmetrical to that of the cord A.

In the embodiment according to FIG. 2 both the cords A and B run through central apertures of the sun blinding portion 3. In case of a sun blind having an even larger width there may be provided two series of center apertures whereby the cords A and B may each run through a corresponding series of apertures.

In the embodiment according to FIG. 2 the cords have been arranged in such a manner that they provide both for the lateral guiding action and for the central guiding action; thereby it is required to provide the additional profiled bar 5 at the bottom sill part of the window frame.

Figure 3:
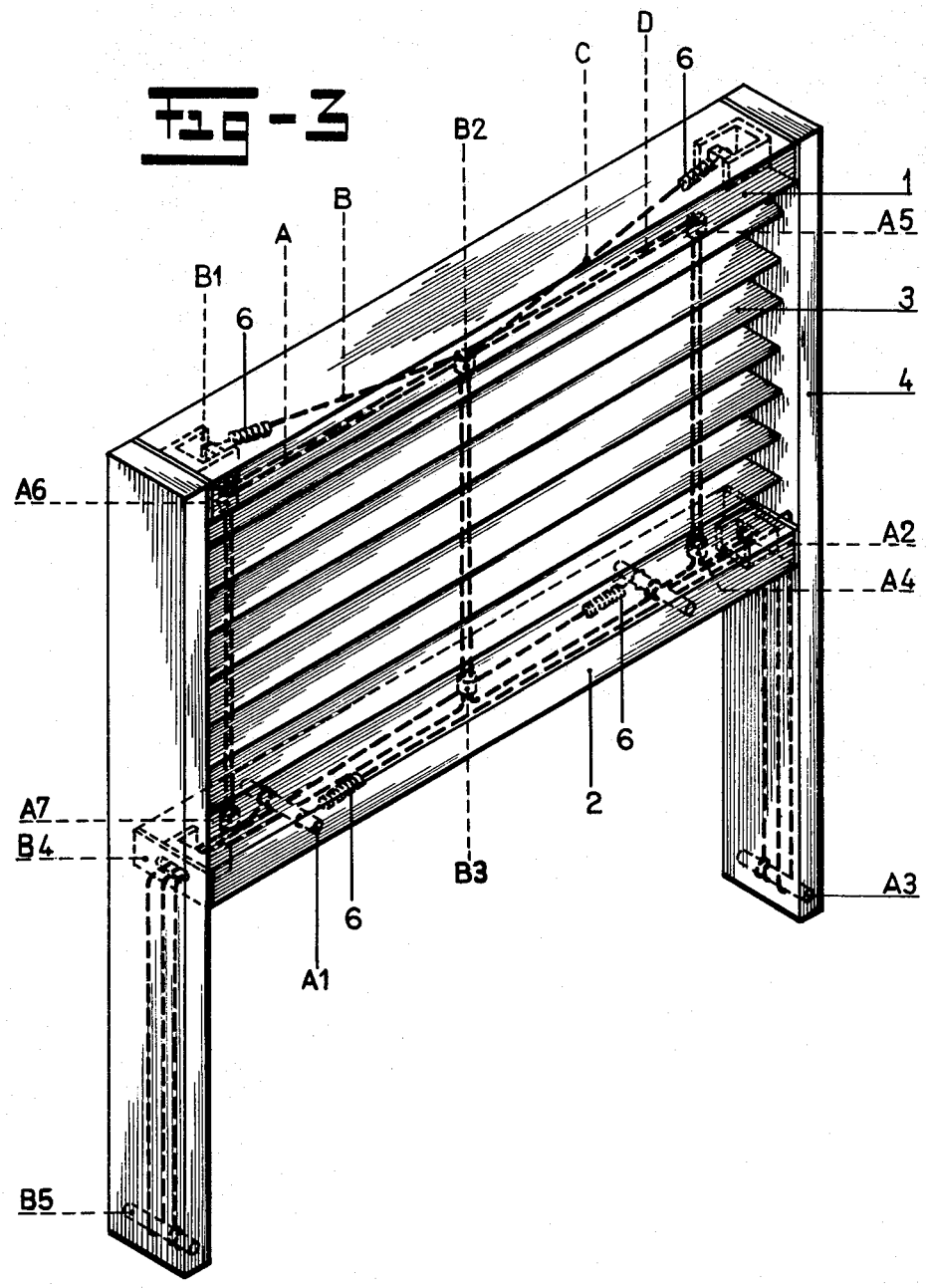
FIG. 3 corresponds to FIG. 1 and is also intended for a wider window frame and includes a center guide.

The sun blind in accordance with the embodiment of FIG. 3 also contains a center guide. In this case there are used four cords, A, B, C and D.

The lateral guide cord A is fastened at A1 within the profiled bar 2 and runs through the bottom bar 2 to A2 while leaving the bottom bar 2 at A2, running downwards to A3 running around the pin A3 upwards to A2, whereupon the cord runs through the profiled bottom bar 2 from A2 to A4 and leaves the bottom bar 2 at A4 while running upwards through the sun blinding portion 3 to A5, entering the profiled top bar 1 at A5, running through the top bar 1 to A6, leaving the top bar 1 at A6 and running downwards through the sun blinding portion 3 to A7 whereupon the cord enters the bottom bar 2 at A7 and runs through the bottom bar 2 to A1, where the cord is fastened.

Again a spring element 6 is incorporated in the cord A close to the point A1.

The center guide cord B is fastened within the profiled top bar 1 at the point B1 and runs through the top bar 1 to B2 while leaving the top bar 1 at B2, running downwards to the central apertures of the sun blinding portion 3 to B3, entering the profiled bottom bar 2 at B3 and running through the bottom bar 2 to B4, whereupon the cord leaves the bottom bar 2 at B4, runs downwards to the pin B5 and is fastened at B5 to said pin.

In the cord B there has also been provided a spring element 6.

The cord C runs symmetrically to the cord B. The cord D runs symmetrically to the cord A.

In this embodiment it is also possible that the center guide cords B and C will run through their own appropriate series of center guide apertures in the sun blinding portion. This embodiment is characterized in that there are two cords A and D providing for the lateral guiding action and two cords B and C functioning as the center guide(s).

The advantage of the sun blind according to the invention is that the sun blind may be opened or closed by seizing the profiled bottom bar 2 with the hand and sliding the same up or down. The bottom bar does not have a chance to occupy an oblique position and will be fixed in any desired position without a separate locking means. This fixation of the position is not lost when the window is toppled about a horizontal axis.

What is claimed is:

1. A sun blind comprising:

a horizontal top bar;

a horizontal bottom bar;

a foldable sun blinding member attached to said top and bottom bars and including a plurality of first aligned openings disposed adjacent to the sides of said member;

first and second vertical side bars adapted to receive and guide the ends of said bottom bar, each of said side bars being located adjacent to one of the sides of said sun blinding member and extending downwardly from said top bar, said plurality of first aligned openings in said sun blinding member being disposed in substantially parallel relationship to and spaced apart from said side bars at a distance therefrom, said bottom bar being adapted for longitudinal slidable movement in said side bars;

cord means for guiding said bottom bar and said sun blinding member when said bottom bar is moved in said side bars, said cord means forming a loop and being coupled to a first fixed starting point in one of said horizontal bars, said cord means extending through said horizontal bar having said fixed starting point, through at least one of said side bars, through said plurality of first aligned openings and through the other of said horizontal bars, said cord means forming a substantially right angle bend between the length of said cord means extending through said bottom bar and the succeeding length of said cord means extending through said plurality of first aligned openings; and spring means coupled to said cord means for providing tension on said cord means so as to take up slack in said cord means and hold said bottom bar and said sun blinding member in a fixed position with respect to said side bars whereby said bottom bar may be grasped by a user to move said bottom bar to any position along the length of said side bars, said bottom bar being retained in said position by said right angle bend in said cord means and the taut condition of said cord means.

2. The sun blind recited in claim 1, further comprising additional core means for guiding said bottom bar and said sun blinding member when said bottom bar is moved in said side bars, said additional cord means forming a loop and being coupled to a second fixed starting point in said horizontal bar having said first fixed starting point, said additional cord means extending through said horizontal bar having said fixed starting points, through at least one of said side bars, through said plurality of first aligned openings and through the other of said horizontal bars.

3. The sun blind recited in claim 1, further comprising a plurality of second aligned openings in said sun blinding member disposed between said plurality of first openings, said cord means being further disposed through said second plurality of openings for guiding the center portion of said sun blinding member when said bottom bar is moved in said side bars.

4. The sun blind recited in claim 3, further comprising an additional horizontal bar disposed between said side bars and below said bottom bar, said cord means also extending through said additional horizontal bar.

5. The sun blind recited in claim 1, further comprising a plurality of second aligned openings in said sun blinding member disposed between said plurality of first openings, and further cord means coupled to and extending through said top bar, said further cord means extending through said second plurality of openings and said bottom bar to one of said side bars, and spring means coupled to said further cord means for providing tension on said further cord means so as to take up slack in said further cord means, said further cord means extending through said second plurality of openings so as to guide the center portion of said sun blinding member when said bottom bar is moved in said side bars.

* * * * *